United States Patent [19]

Martinez

[11] Patent Number: 4,726,895

[45] Date of Patent: Feb. 23, 1988

[54] PROCESS FOR CONCENTRATION OF GOLD AND URANIUM MAGNETICALLY

[76] Inventor: Edward Martinez, 13 Bayswater Pl., Chapel Hill, N.C. 27514

[21] Appl. No.: 846,269

[22] Filed: Mar. 28, 1986

[51] Int. Cl.[4] ..... B03B 1/04; B03C 1/00; C22B 1/00; C22B 11/04

[52] U.S. Cl. ..... 209/2; 75/1 R; 75/118 R; 209/8; 209/10; 209/214; 209/215; 423/3; 423/25

[58] Field of Search ..... 209/1-3, 209/4, 8, 10, 212-215, 38, 39, 40; 75/118 R, 121, 1 R; 423/25, 3, 274; 241/24; 266/168, 169; 420/3

[56] References Cited

U.S. PATENT DOCUMENTS

| | | | |
|---|---|---|---|
| Re. 30,360 | 8/1980 | Shubert | 209/8 |
| 537,336 | 4/1895 | Baker | 209/8 |
| 2,042,121 | 5/1936 | Parker | 75/118 R X |
| 2,965,440 | 12/1960 | Tripp | 423/3 |
| 4,272,491 | 6/1981 | Schultze et al. | 423/3 X |
| 4,435,284 | 3/1984 | Heytmeijer | 209/10 X |
| 4,494,986 | 1/1985 | Forsman | 75/118 R X |

FOREIGN PATENT DOCUMENTS

| | | | |
|---|---|---|---|
| 1145951 | 5/1983 | Canada | 423/25 |
| 0066419 | 12/1982 | European Pat. Off. | 423/3 |
| 54-137417 | 10/1979 | Japan | 423/3 |
| 0733218 | 7/1955 | United Kingdom | 209/8 |

OTHER PUBLICATIONS

N. Hedley and Tabachnick, H., Chemistry of Cyanidation, Mineral Dressing Notes, Jun. 1958.

A. F. Taggart, Handbook of Mineral Dressing, pp. 2-72, 1945.

C. E. Feather and G. M. Koen, The Significance of the Mineralogical Surface Characteristics of Gold Grains and the Recovery Process, J. South African Inst. of Mining and Metallurgy, Mar. 1973.

I. J. Corrans and J. Levin, Wet High-Intensity and Magnetic Separation for the Concentration of Witwatersrand Gold-Uranium Ores and Residues, J. South African Inst. of Mining and Metallurgy, Mar. 1979.

H. von Michaelis, Innovations in Gold and Silver Recovery, Society of Mining Engineers of AIME, Mar. 1983.

*Primary Examiner*—Robert B. Reeves
*Assistant Examiner*—Edward M. Wacyra
*Attorney, Agent, or Firm*—Stiefel, Gross, Kurland & Pavane

[57] ABSTRACT

A process for concentrating gold and/or uranium minerals by rendering the nonmagnetic minerals magnetic or weakly magnetic by causing a coating to form on the surfaces of the minerals. The gold and/or uranium are concentrated by use of a gravity-magnetic separator or a suitable high intensity magnetic separator.

20 Claims, 1 Drawing Figure

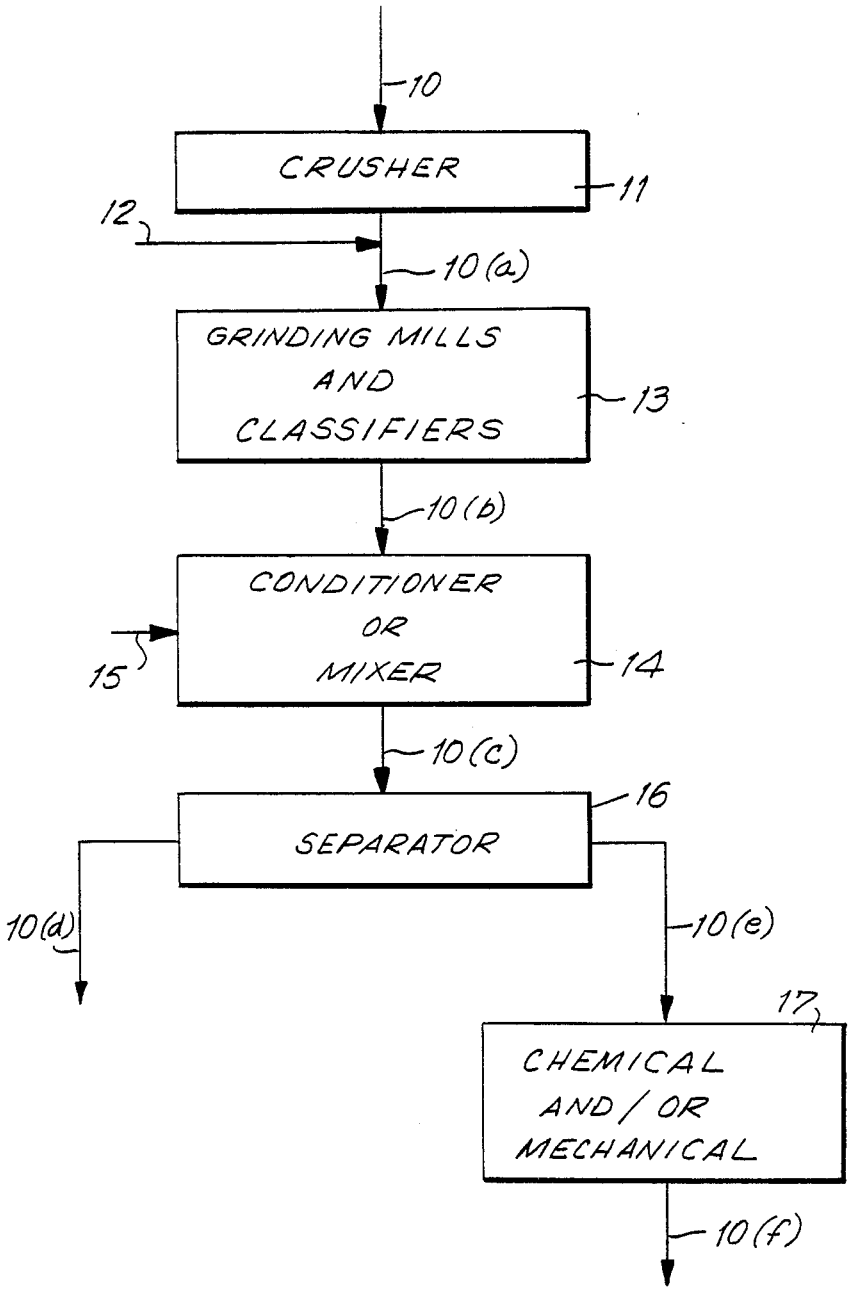
10
CRUSHER
11
12
10(a)
GRINDING MILLS AND CLASSIFIERS
13
10(b)
CONDITIONER OR MIXER
14
15
10(c)
SEPARATOR
16
10(d)
10(e)
17
CHEMICAL AND / OR MECHANICAL
10(f)

PROCESS FOR CONCENTRATION OF GOLD AND URANIUM MAGNETICALLY

TECHNICAL FIELD

This invention relates to a process for the recovery of gold from ores, tailings, and residues. It depends on making the gold particles in said materials magnetic or weakly magnetic by chemical or other means and recovering said gold particles by use of gravity-magnetic type separators. The separator utilizes both gravity and magnetic forces to achieve separation capabilities in excess of that which can be achieved by either wet high intensity magnetic separation or gravity separation

BACKGROUND ART

In the treatment of gold ores it has been found that the gold particles are quite often tarnished. Hedley and Tabachnick (Chemistry of Cyanidation, June 1958) state that the effect of such coverings is to retard dissolution in the cyaniding process and to increase gold losses. In addition these gold particles are difficult to amalgamate or to recover by flotation. Taggart (*Handbook of Mineral Dressing,* Sect. 2, p. 72, Wiley, 1945) reported that one type of nonamalgable gold ores was where the gold is coarse enough to amalgamate, but is so coated on the surface (rusty) that it is not wetted by the mercury.

The mechanism for the formation of the coating is not understood. Feather and Koen (Jnl. of South Africa Inst. of Mining & Metallurgy, Feb. 1973, pp. 223–234) found that free gold grains were enveloped in distinct coatings of hydrated iron oxide. Such coatings have an adverse effect on subsequent metallurgical processes such as cyanidation, amalgamation, and flotation and Feather and Koen stated that the loss of free gold is probably related to the heavy tarnish on the grains and to the effects of excessive milling (grinding). They reported that, "during ball milling copious quantities of finely divided iron are produced. From here onward, the iron plays its deleterious role in the circuit." Recommendations were made to minimize or prevent the formation of such coatings because of the adverse efffect on metallurgical processing.

The coatings render said particles magnetic or weakly magnetic. During the 1970's magnetic separation tests were carried out in South Africa to recover these weakly magnetic gold and uranium particles from tailings and residues by the use of wet high intensity-magnetic separation, the only known method for recovering these particles. The test results are discussed by Corrans and Levin (Jnl. of South African Inst. of Mining & Metallurgy, March 1979, pp 210–228) However, wet high-intensity magnetic separation has high operating and capital costs, is energy intensive in that it consumes much power, and has a low capacity compared to gravity or gravity-magnetic types of separators. A further disadvantage, reported by Corrans in an unpublished paper, is that wet high-intensity magnetic separators are subject to blockage due to wood chips and ferromagnetic materials (magnetite, pyrrhotite, and ilmenite) present in the slurries being treated. Another disadvantage is the low recovery achieved by the wet high intensity magnetic separation. Corrans and Leven reported in 1979 that the main source of loss was the inefficiency of the separator in the recovery of material smaller than 20 micrometers. In 1983, H. von Michaelis reported after an extensive review of methods for recovering gold, "the question might be asked whether iron coated gold could not be recovered by magnetic separation to make a concentrate for further treatment, but so far no commercial application of magnetic separation was found" (Society of Mining Engineers, American Institute of Mining & Metallurgical Engineers, Preprint 83–119, March 1983).

The lack of success in recovering the weakly magnetic gold particles by wet high intensity magnetic separation lead to the idea that the Gravity-Magnetic Separator (South African Pat. No. 84/2130, May 29, 1985; U.S. Pat. No. 4,565,624, Jan. 21, 1986), which recovers high specific gravity weakly magnetic minerals, would recover the weakly magnetic, high specific gravity gold particles. Furthermore, many gold ores are recovered by gravity concentration and fine-sized gold particles are lost to the tailings. In the paper cited above Feather and Koen reported that, "unfortunately, the particles of free gold and iron have by now acquired similar properties, and both are of high specific gravity." Gold has a specific gravity of 19.3 which makes it amenable to gravity separation, but this method is also inefficient in the recovery of small gold particles and those which are flaky. Therefore, instead of attempting to prevent or minimize the formation of coatings, a method has been provided to make the gold particles magnetic and using a Gravity-Magnetic Separator increase recovery of said gold particles.

The purpose of the invention is to provide a commercial, low cost, high capacity, environmentally safe process for the recovery of gold and/or uranium minerals from ores. A further objective is to recover gold and/or uranium minerals from tailings and residues that are now being discarded as to waste. Another purpose is to provide a process for economically treating gold and/or uranium tailings dump material.

The present invention is a process in which reagents, chemicals, or additives, both inorganic and organic are added to the slurry to cause the formation of a coating on the gold and/or uranium minerals present in the slurry of ore, tailings, or residue. Said coatings would be one that renders the desired species to be recovered to become magnetic or weakly magnetic. The new process uses means to accelerate said coatings to form, in contrast to present processes which attempt to prevent the formation of such coatings.

The treated slurries can be fed to a gravity-magnetic type separator, which is the subject of a U.S. pat. (U.S. Pat. No. 4,565,624, E. Martinez, Jan. 21, 1986). This type of separator will recover high specific gravity, weakly magnetic particles. It has a high capacity, low operating costs, and low energy requirements.

It may be necessary after making a concentrate of the gold and/or uranium particles by this new process to remove the coating for subsequent metallurgical treatment. Treatment of the concentrates with acid, such as hydrochloric acid, or other reagents may be required.

One of the advantages of the invention is that it provides a physical procedure for concentrating gold and/or uranium minerals from ores, tailings, or residues. A further advantage is that it provides an environmentally safe method for recovery of gold and/or uranium minerals. Another advantage is that it provides a comparatively simple and inexpensive procedure for effecting such a separation. Another important advantage is that the invention permits the exploitation of lower grade ores than would be possible in the absence of the invention. Another advantage is that it permits the recovery of values now lost in the tailings of existing operations. A further extremely important advantage of the invention is that it permits the useful life of the mine to be extended.

These and other advantages will become apparent from the following more detailed description of the invention.

Accordingly, it is an object of the present invention to provide a means for recovering gold and uranium minerals by rendering said particles magnetic or weakly magnetic by the addition of suitable chemicals or reagents so that said particles can be concentrated or recovered by means of a gravity-magnetic type separator (U.S. Pat. No. 4,565,624, E. Martinez) or other suitable magnetic type separator.

DISCLOSURE OF THE INVENTION

The present invention is a process for treating gold and uranium feed materials, such as ores, tailings or residues to make the gold and/or uranium minerals magnetic or weakly magnetic. The magnetic or weakly magnetic gold and/or uranium minerals can then be separated or recovered by any suitable magnetic separator but preferably by means of a gravity-magnetic type separator which utilizes a magnet means for applying a magnetic attractive force which is co-directional with the force of gravity. (U.S. Pat. No. 4,565,624, E. Martinez).

In a typical embodiment of the invention, chemicals or reagents are added to the slurry of the feed material which will cause a coating to be formed on the desired species to be concentrated, i.e., gold and/or uranium minerals. The coating renders said particles magnetic or weakly magnetic. The additives to the slurry could be in the form of fine iron particles or a hydrated iron oxide which would react with said minerals to form a hydrated iron oxide coating. The addition of iron particles will cause the free gold particles to acquire similar properties, in that both would have a high specific gravity and be magnetic. Free gold has a specific gravity of 19.3. Such high specific gravity, magnetic or weakly magnetic minerals can be recovered by gravity-magnetic type separators.

Formation of the coating rendering the minerals magnetic or weakly magnetic makes them suitable for recovery on a gravity-magnetic type separator. This type of separator has numerous advantages over the wet high intensity magnetic separator. Finer sized particles are recovered and the separator has a higher unit capacity, lower operating and capital costs compared to the wet high intensity magnetic separator. In addition the presence of ferromagnetic minerals in the feed can be handled without clogging. It can also handle wood chips and other extraneous material that may be present in the feed material and would clog a wet high intensity magnetic separator.

A conditioner or tank with a mixer may be advantageously utilized in which the additives or reagents are added to the slurry and agitated for a period of time, sufficient for the magnetic or weakly magnetic coating to form on the desired species. If sufficient iron or other material to form said coating is already present in the slurry, such as iron from the crushing and grinding steps, a conditioner may be necessary to allow sufficient residence time for the coating to form.

The coating on the gold and/or uranium minerals may have adverse effects on subsequent metallurgical processes that may be necessary, such as cyanidation, amalgamation, or flotation. Treatment of the concentrates with acids, such as hydrochloric acid, or other reagents may be required to remove the coatings.

The invention is further illustrated in the accompanying drawing. It should be understood that the drawing is given for purposes of illustration and that the invention in its broader aspects is not limited thereto.

In the drawing, FIG. 1, is a flowsheet illustrating a preferred mode of practicing the invention for recovery of values from an ore.

Referring now to the drawing, FIG. 1, the numeral 10 represents a feed stream of material containing gold, which may be ore from the mine or previously crushed ore, fed to a crusher 11, such as a jaw crusher or a gyratory crusher. Stream 10(*a*) is the crushed feed material fed to the grinding-classification circuit 13. Water 12 is added to the crushed feed stream prior to the grinding-classification circuit 13.

Stream 10(*b*) is the wet ground feed material containing gold which is fed to a conditioner or tank with an agitator 14 to which is added the reagent or chemical 15 to form a coating on the gold particles in the feed material rendering said gold particles magnetic or weakly magnetic.

The separator 16 is preferably a gravity-magnetic type separator to recover the gold particles from the feed stream 10(*c*). It will be understood by those skilled in the art that the separator 16 could be one or a multiplicity of separators in the form of rougher, cleaner, and scavenging steps.

Stream 10(*d*) is the tailings stream comprising predominantly low specific gravity particles. Stream 10(*d*) may go to the tailings pond or to further metallurgical processing.

Stream 10(*e*) is the concentrate which is comprised largely of high specific gravity weakly magnetic particles, including the coated gold particles.

In processing tailings, residues or other feed materials it may be possible to eliminate the crushing 11 and grinding 13 steps and feed the material directly to the conditioner 14. In the case of some tailings and residues, a magnetic or weakly magnetic coating may have formed on the surfaces of the gold particles during the previous processing steps and said feed may be sent directly to the separator 16.

In FIG. 1, numeral 17 is an optional step which may be needed in some metallurgical operations. It represents a means for removal of the coating from the gold particles in the concentrate by chemical additives and/or by mechanical means. This step may be required if the gold concentrate stream 10(*e*) is going to a subsequent treatment such as cyanidation, amalgamation, or flotation. Stream 10(*f*) is the concentrate with the coating on the gold particles removed.

Finally, it is to be understood that the above-described embodiments of the invention are intended to be illustrative only and that numerous alternative embodiments of the invention may be followed by those skilled in the art without departing from the scope and spirit of the claims that follow.

What is claimed is:

1. A process for separating gold particles from a slurry of feed material comprising gold particles and other non-magnetic materials, said process comprising the steps of:

(1) forming a magnetic coating on the gold particles by adding to the slurry, under substantially atmospheric conditions, an additive comprising one or more chemicals that render said particles magnetic or weakly magnetic; and (2) separating and recovering said coated gold particles by subjecting the coated gold particle containing slurry to magnetic separation to thereby obtain a concentrate of gold particles.

2. The process of claim 1, and further comprising the step of removing the coating from the concentrate of gold particles.

3. The process of claim 2, wherein the coating is removed by chemical or mechanical means.

4. The process of claim 3, wherein the chemical means comprises an acid treatment.

5. The process of claim 4, wherein the acid is hydrochloric acid.

6. The process of claim 1, wherein the feed material is selected from the group consisting of ore, tailings and residue.

7. The process of claim 1, wherein the additive is selected from the group consisting of iron powder, hydrated iron oxide solution, and mixtures thereof.

8. The process of claim 1, and further comprising the step of agitating the slurry containing the additive to thereby accelerate formation of the coating.

9. The process of claim 1, wherein the coated gold containing slurry is subjected to gravity-magnetic separation.

10. The process of claim 1, wherein the additive comprises a mixture of organic and inorganic materials.

11. A process for separating uranium particles from a slurry of feed material comprising uranium particles and other non-magnetic material, said process comprising the steps of (1) forming a magnetic coating on the uranium particles by adding to the slurry, under substantially atmospheric conditions, an additive comprising one or more chemicals that render said particles magnetic or weakly magnetic; and (2) separating and recovering said coated uranium particles by subjecting the coated uranium particle containing slurry to magnetic separation to thereby obtain a concentrate of uranium particles.

12. The process of claim 11, and further comprising the step of removing the coating from the concentrate of uranium particles.

13. The process of claim 12, wherein the coating is removed by chemical or mechanical means.

14. The process of claim 13, wherein the chemical means comprises an acid treatment.

15. The process of claim 14, wherein the acid is hydrochloric acid.

16. The process of claim 11, wherein the feed material is selected from the group consisting of ore, tailings and residue.

17. The process of claim 11, wherein the additive is selected from the group consisting of iron powder, hydrated iron oxide solution, and mixtures thereof.

18. The process of claim 11, and further comprising the step of agitating the slurry containing the additive to thereby accelerate formation of the coating.

19. The process of claim 11, wherein the coated uranium containing slurry is subjected to gravity-magnetic separation.

20. The process of claim 11, wherein the additive comprises a mixture of organic and inorganic chemicals.

* * * * *